US005804757A

United States Patent [19]

Wynne

[11] Patent Number: 5,804,757

[45] Date of Patent: Sep. 8, 1998

[54] FLEXIBLE, LIGHTWEIGHT, COMPOUND BODY ARMOR

[75] Inventor: Robert C. Wynne, Grand Island, N.Y.

[73] Assignee: Real World Consulting, Inc., Grand Island, N.Y.

[21] Appl. No.: 625,182

[22] Filed: Mar. 29, 1996

[51] Int. Cl.[6] ..... F41H 1/02

[52] U.S. Cl. ..... 89/36.05; 89/36.02; 2/2.5

[58] Field of Search ..... 89/36.05, 36.02; 2/2.5, 463, 464

[56] References Cited

U.S. PATENT DOCUMENTS

| | | | |
|---|---|---|---|
| 2,723,214 | 11/1955 | Meyer | 89/36.05 |
| 3,577,836 | 5/1971 | Tamura | 2/2.5 |
| 4,483,020 | 11/1984 | Dunn | 2/2.5 |
| 4,633,756 | 1/1987 | Rudoi | 89/36.02 |
| 5,087,516 | 2/1992 | Groves | 2/2.5 |
| 5,110,661 | 5/1992 | Groves | 2/2.5 |
| 5,187,023 | 2/1993 | Prevorsek et al. | 428/911 |
| 5,196,252 | 3/1993 | Harpell | 428/911 |
| 5,254,383 | 10/1993 | Harpell et al. | 428/911 |
| 5,306,557 | 4/1994 | Madison | 428/911 |
| 5,327,811 | 7/1994 | Price et al. | 2/2.5 |
| 5,332,545 | 7/1994 | Love | 420/420 |
| 5,362,527 | 11/1994 | Harpell et al. | 425/911 |
| 5,376,426 | 12/1994 | Harpell et al. | 428/911 |

FOREIGN PATENT DOCUMENTS

| | | | |
|---|---|---|---|
| 20656 | of 1903 | United Kingdom | 89/36.02 |
| 915345 | 1/1963 | United Kingdom | 2/2.5 |

OTHER PUBLICATIONS

The Slug Stops Here by Cliff Gromer, Popular Mechanics. Aug. 1994, pp. 51–52.

New Urban Battlefield Calls for Body Armor, National Defense, Jul./Aug. 1995, p. 36.

Analysis of the Temperature Rise in the Projectile and Extended Chain Polyethylene Fiber Fiber Composite Armor During Ballistic Impact and Penetration by Dusan C. Prevorsek, Young D. Kwon, and Hong B. Chin, Polymer Engineering and Science, Jan. 1994, vol. 34, No. 2 pp. 141–152.

(List continued on next page.)

*Primary Examiner*—Stephen M. Johnson
*Attorney, Agent, or Firm*—M. Lukacher

[57] ABSTRACT

Flexible, lightweight, compound body armor has multiple protective layers designed to defeat incoming projectiles. The first protective layer has a flexible base layer of penetration-resistant material having, fastened to its surface, facing the exterior, a first matrix of individual hard non-planar elements, the front surface of which is non-planar and shaped such that upon impact on the surface of these individual hard non-planar elements, projectiles would be turned or rotated to change the orientation of said projectiles with respect to the surface of said protective layers in such a manner that instead of the point, the side of a projectile would now be directed toward the subsequent protective layers, thus presenting a much larger area to said subsequent protective layers and therefore distributing the impact energy over a larger area and slowing down further penetration of said projectiles. To slow down or defeat penetration through said body armor of said projectiles which may impact between said individual hard non-planar means fastened to the surface of said first protective layer, at least one second protective layer is situated beneath the first protective layer. The second protective layer also has a base layer of penetration-resistant material that has fastened to its surface, facing the exterior, a second matrix of individual hard non-planar elements, the front surface of which is non-planar and shaped such that upon impact on the surface of these individual hard non-planar elements.

22 Claims, 11 Drawing Sheets

OTHER PUBLICATIONS

U.S. Statutory Invention Registration—H1434, issued May 2, 1995 by Cytron.

J. C. Field—USA—ERO—Investigation of the Impact Performance of Various Glass and Ceramic Systems (Aug. 1988).

Development and Current Status of Armor Ceramics, Dennis J. Viechnicki, Michael J. Slavin and Morton L. Kilman; Ceramic Bulletin vol. 70, No. 6, 1991; pp. 1035–1039.

USA Natick RD&E Center, Report. No. Natick /TR–89/0076 (Oct. 1988), pp. 1–38.

Allied Signal Fibers, Stopping Power, 1994.

FLEXIBLE, LIGHTWEIGHT, COMPOUND BODY ARMOR

FIELD OF INVENTION

This invention relates to Armor and particularly to a flexible, lightweight, compound body armor, comprising individual hard non-planar means and penetration-resistant (ballistic) materials, for protection of the wearer against bullets, shrapnel, and other sharp or pointed objects, with increased wear comfort.

BACKGROUND OF INVENTION

There exists a constantly increasing threat of injury or death to military and law enforcement personnel from bullets, fragments, flechettes, shrapnel and other projectiles. A recent magazine article states that "The percent of combat casualties from direct-fire infantry weapons could rise from approximately 15 to 50% when the battlefield shifts from the country to urban area" (National Defense, July/August 1995). There is also a fast-growing threat of injuries or fatalities to the police and the members of other law enforcement agencies from the use by perpetrators of firearms.

Numerous garments to protect the wearer against projectiles have been developed and are now available, for example, the Personnel Armor System for Ground Troops (PASGT), Combat Vehicle Crewman Fragmentation Protection Vest (CVC FPV), Ultra Shield HP II and Dyna-Shield Plus (A&B Industries), the ABA Body Armor Series by American Body Armor and Equipment), the SBA Series (Dowty Armorshield), NASS Models (National Armor), and many others.

The personal body armor can be divided into two broad classes: rigid and flexible; in turn, the flexible body armor can either comprise only ballistic woven or non-woven fabrics, or be compound body armor comprising ballistic fabrics and interspersed hard inserts of polymer, metal, cermet or ceramic materials. The rigid body armor is generally a ballistic fabric garment with pockets for inserts of relatively large plates of hard materials, such as metal, ceramics, or polymers such as the SPECTRA® SHIELD. The outer layer of the body armor is backed up with multiple layers of ballistic fibers to afford additional protection.

Body armor provides protection to the critical areas of the body against impacting projectiles by dissipating their kinetic energy through energy transfer from the projectile to the protective materials, breaking up the projectiles, slowing them down, and, in a favorable outcome, completely arresting their penetration. Ideally, the body armor also significantly reduces the effects of blunt object impact that may cause trauma to the body of the wearer.

The mechanisms involved in this process are very different for ballistic fabrics, ceramics or metals.

Flexible body armor using ballistic fabrics absorbs the energy of the incoming projectiles by stretching the fibers without breaking them. Closely woven or nonwoven fibers of polyaramids, such as DuPont's KEVLAR® and TWARON® (Akzo, Belgium), or high strength polyethylenes (Allied Signal's SPECTRA®) are used to produce ballistic fabrics. Multiple layers of such fabrics are utilized to make body armor that provides protection against low or moderate velocity and momentum threats. Obviously, the more layers of ballistic fabric are used in a body armor, the higher degree of protection such garment will provide, the heavier and less flexible it is, and the less comfortable it is to wear. This lack of comfort attendant with the higher degree of protection results in a greater resistance by personnel against wearing it, especially in hot weather or when strenuous activity is involved. As a result, the fabric-only body armor is not practical to use as protection against high velocity, high momentum projectiles.

U.S. Pat. Nos. 5,362,527 and 5,254,383, for example, describe several variations of fabric-only body armor. The differences between these patents are in the manner in which panels or sheets of ballistic fabric are used to form body armor.

Rigid body armor provides a higher degree of protection against high velocity, greater momentum projectiles, but is heavy and uncomfortable to wear. It is therefore, generally, limited to use with personnel in vehicles where not much movement is involved, or in special situations, such as deactivation of mines, bombs, or other explosive devices. The materials which are used in rigid body armor as inserts are metals such as hard non-planar steel, aluminum, and titanium; ceramics, such as alumina, silicon carbide, boron carbide, and others, including fiber reinforced ceramics and fiber glass; polymers, such as the above mentioned SPECTRA® SHIELD. Each of these classes of hard materials defeats the incoming threats by way of different mechanisms:

Metals. If the armor metal is harder than the projectile, in its initial interaction with the projectile its tip is blunted, thus enlarging the impact area and providing a greater distribution of the kinetic energy. This action is followed, again depending on the properties of the projectile, its momentum, the angle, and the speed of the impact, by fracturing of the projectile, deforming it and reducing its mass through abrasion, and slowing it down through friction and transfer of momentum, and by transfer of energy resulting in the local deformation of the metal armor, and heat generation. Generally, the metal elements of the armor are not fractured, but are distorted as spall is generated, and a hole is formed where the projectile penetrates the metal. Body armor employing metals tends to be heavier than that using ceramics or polymers Ceramics: Ceramic components are used preferentially over metal in both rigid and flexible body armor. The reasons are: lower weight for the same amount of protection, higher hardness, and more effective mechanisms for defeating incoming threats.

J. C. Fields in his 1988 report entitled "Investigation of the Impact Performance of Various Glass and Ceramic Systems" (U.S. Army, European Research Office, Cavendish Laboratory, UK) states: "The two great advantages of ceramic armor compared to metallic are: (i) the lower density; (ii) the load spreading. The point is that whereas the hole formed by impact with metal has a diameter of about the same size as the projectile, the ceramic forms a conoid which spreads the load." This statement reflects the nature of the mechanism of interaction between the ceramic armor component and the incoming projectile, which is energy absorption through fracture, breaking up of the projectile into fragments by ceramics of sufficient hardness, and deformation of the projectile through abrasion. Fields also states that the best ceramics for use in body armor are those with the highest ratio of hardness to density; one such ceramic material is boron carbide, $B_4C$.

One disadvantage of ceramics in rigid body armor that an impact of a projectile generates not only a local conical fragmentation of the material, but also causes cracks in the entire plate, thus making such plates useless as a protection for further impacts.

Polymers: Fibers made of polymers, such as polyaramids and high density polyethylene can be used to produce rigid plates by using them in matrices in conjunction with appropriate resins. SPECTRA SHIELD is a good example of such materials. Although relatively light weight, rigid polymeric armor components offer less protection than ceramics.

Compound body armor combines the advantages of the fabric-only protective garments and rigid body armor in that it provides greater protection than the equal weight fabric-only armor, and is lighter and more comfortable to wear than the rigid armor.

Compound body armor comprises multiple protective layers of ballistic fabrics interspersed with hard metal or ceramic or cermet elements. Such elements are individually much smaller in size than the hard plates used in rigid armor, a construction which facilitates a much greater flexibility and wear comfort compared to the rigid armor. In the prior art several concepts of compound body armor have been disclosed:

U.S. Pat. No. 5,110,661 delineates a multilayer flexible body armor that in addition to layers of penetration resistant fabric contains a plurality of hard round beads enclosed between layers of fabric. The projectiles are said to be slowed down and trapped by the beads and the fabrics. Effective protection against high speed projectiles is claimed.

U.S. Pat. No. 5,187,023 discloses a flexible composite multilayer material for use in body armor, that includes a plurality of hard planar metallic bodies affixed to the front surface of at least one of the layers.

U.S. Pat. No. 5,196,252 describes a similar flexible composite multilayer material for use in body armor, that includes a plurality of hard planar bodies of polymeric substances, affixed to the front surface of at least one of the layers.

U.S. Pat. No. 5,254,383 claims increased effectiveness in defeating threats of a flexible composite material that incorporates in at least one layer hard planar bodies covered with a network of ballistic fibers.

U.S. Pat. No. 5,362,527 discloses a multilayer body armor material comprising at least three layers of protective materials, of which the two first layers have affixed to their front-facing surface a plurality of planar bodies of metal or ceramic, such that planar bodies in the second layer are distributed such so as underlie the areas not protected by the planar bodies of the first layer.

U.S. Pat. No. 5,376,426 describes another multilayer body armor material comprising at least one layer of "fibrous material" and at least one layer of "planar bodies" of metal or ceramic, the latter bodies affixed to the supporting fabric material. The material is said to provide greater protection than other materials comprising only fabrics or only metal planar bodies.

All of these patents describe flexible body armor concepts which involve significant compromises between the degree of protection they offer, their weight and the wearer's comfort.

SUMMARY AND OBJECTS OF THE INVENTION

It is one object of the present invention to provide an improved flexible compound body armor that provides improved protection against projectiles, has lower weight and is more comfortable to wear.

Another object of the present invention is to provide an improved flexible compound body armor that comprises at least four protective layers of materials.

A further object of the present invention is to provide an improved flexible compound body armor that includes at least the first and the second protective layers of flexible penetration-resistant fabric on the front surface of which are affixed matrices comprising individual hard non-planar means.

An additional object of the present invention is to provide an improved flexible compound body armor in which said individual hard non-planar means are shaped like pyramids the bases of which are either triangles, rectangles, trapezoids, polygons, or squares, said bases affixed to the front surface said flexible penetrationresistant fabric, Yet another object of the present invention to provide an improved flexible compound body armor that contains said individual hard non-planar means the purpose of which is to turn, rotate or reorient the incoming projectile such that said projectile would present to said protective layers its side rather than its tip thus increasing the area of impact and causing the distribution of the impact force over a larger area.

It is also an object of the present invention to provide an improved flexible compound body armor in which said second protective layer has affixed to its front surface said matrix of individual hard non-planar means distributed such that the geometrical centers of said individual hard non-planar means are located directly beneath the junction points of said first protective layer where the apexes of the bases of adjacent said individual hard non-planar means meet, i.e., beneath the points where said first protective layer provides no protection against impacting projectiles.

A further object of the present invention is to provide an improved flexible compound body armor in which said individual hard non-planar means affixed to said second protective layer are pyramids.

An additional object of the present invention is to provide an improved flexible compound body armor in which said individual hard non-planar means affixed to said second protective layer are truncated pyramids.

A further object of the present invention is to provide an improved flexible compound body armor that includes at least one layer of flexible woven or non-woven penetration-resistant fabric.

An additional object of the present invention is to provide an improved flexible compound body armor in which the spaces between said individual hard nonplanar means affixed to the front surfaces of said first and second protective layers are filled with soft polymeric material designed to provide protection against skin injury on the apexes of said individual hard non-planar means affixed to said first protective layer and to entrap any fragments of said projectile or said individual hard non-planar means, said fragments resulting from collision between said projectile and said individual hard non-planar means.

Another object of the present invention is to provide an improved flexible compound body armor in which said individual hard non-planar means are made of metal.

An additional object of the present invention is to provide an improved flexible compound body armor in which said individual hard non-planar means are made of composite material.

Yet another object of the present invention is to provide an improved flexible compound body armor in which said individual hard non-planar means are made of ceramic.

A further object of the present invention is to provide an improved flexible compound body armor in which said individual hard non-planar means are made of cermet.

Another object of the present invention is to provide an improved flexible compound body armor in which said individual hard non-planar means are made of polymer.

A further object of the present invention is to provide an improved flexible compound body armor that provides protection to the torso, abdomen, neck, and extremities of the wearer.

The invention may attain one, more or all of the foregoing objects and is not limited to the attainment of all thereof.

This invention relates to light-weight, flexible body armor that comprises multiple protective layers of penetration-resistant fabrics, at least two of which have affixed to their surface appropriately spatially distributed hard, non-planar, pyramid-shaped means designed to turn, redirect, or rotate the incoming projectiles such that the projectile would present to the protective layers its side rather than its tip thus increasing the area of impact and causing the distribution of force over a larger area. This mechanism is intended to slow down the projectile and to distribute the force of its impact over a much larger area so that the projectile can be entrapped by the subsequent multiple layers of penetration-resistant (ballistic) materials. The resulting body armor will offer greater protection against incoming threats than other types of flexible body armor and will be more comfortable to wear.

BRIEF DESCRIPTION OF THE DRAWINGS

The present invention will be more fully understood with reference to the following detailed description thereof, when read in conjunction with the attached drawings, wherein like reference numerals refer to like means, and wherein.

DETAILED DESCRIPTION

The essential idea of this invention is to produce flexible and light-weight body armor that would defeat the incoming projectiles by two mechanisms: ensuring in majority of the cases that the incoming projectile enters said armor at an oblique angle and, more importantly, said projectile is rotated from its initial orientation to an orientation that would ensure that said projectile progresses through the upper layers of said armor with its major axis increasingly inclined with respect to the planes or surfaces of the protective layers in said armor. In this manner, said projectile, as it moves through the armor, increasingly presents to said layers its broad side with its much larger area. The force of the impact is thus much more distributed (compared to an impact in which the major axis of said projectile is essentially perpendicular to the surfaces of said layers within the armor) and, consequently, said projectile is ultimately stopped by one of said layers in said armor.

Figure 1A:
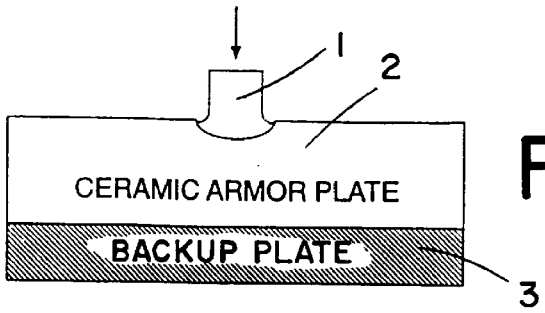
FIGS. 1A–1D illustrate the defeat mechanism of ceramic armor material.
Figure 1B:
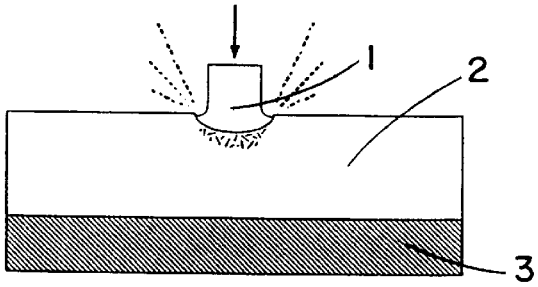
Figure 1C:
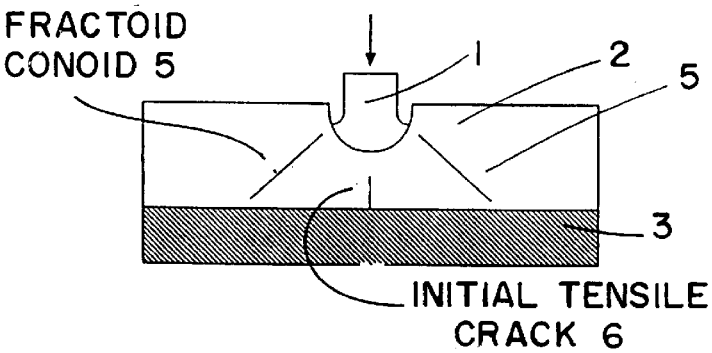
Figure 1D:
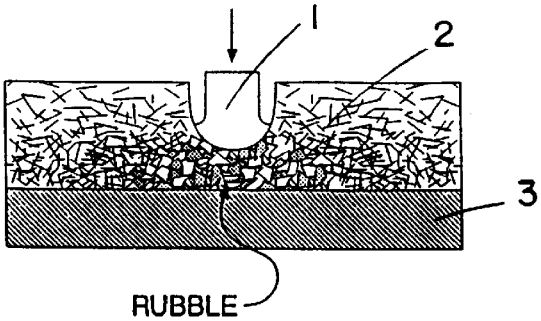

FIGS. 1A–1D show diagrammatically what happens when a projectile 1 impacts vertically a flat rigid ceramic armor plate 2 attached to an appropriate backing 3. The energy of said projectile 1 is absorbed by the ceramic material by two mechanisms: deformation of the front surface of the projectile 1, thus forming a larger impact area (FIG. 1A); and by first generating fractures and cracks (5, 6) in said ceramic material (FIGS. 1B and C), then reducing said ceramic material to rubble (FIG. 1D).

There are serious problems with this type of armor. First, in order defeat high speed projectiles, such as bullets, said ceramic plate has to be sufficiently thick and dense, hence heavy, to stop such projectile by absorbing its kinetic energy. Second, thick ceramic plates cause the armor to be heavy, rigid, inflexible and thus uncomfortable to wear.

Figure 2A:
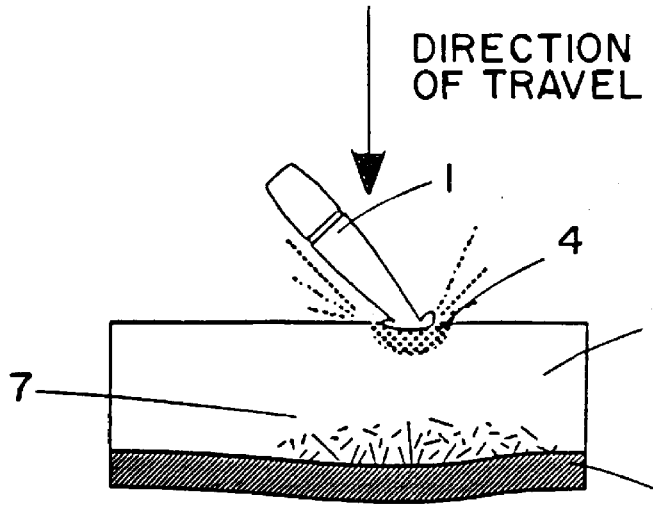
FIGS. 2A, 2B and 2C show the defeat of a projectile by a ceramic armor plate with backing of ballistic material.
Figure 2B:
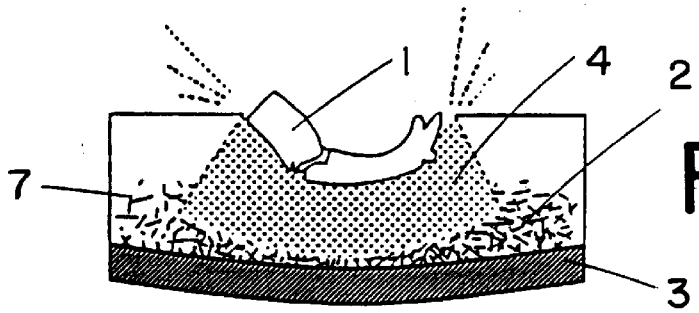
Figure 2C:
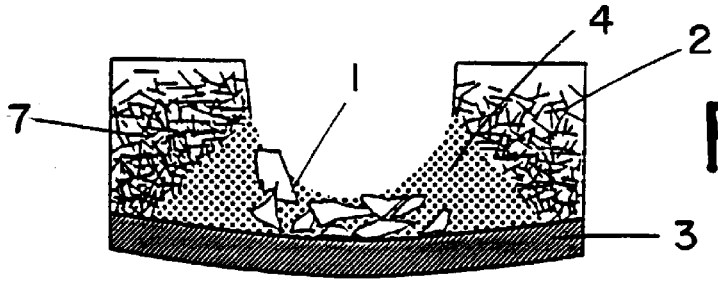

FIGS. 2A–2C illustrate the impact into ceramic armor plate of a projectile 1 that is turned from its initial orientation that was parallel to the direction of its travel. Because of the significantly larger area of impact and the consequent greater spatial distribution of impact energy, thinner ceramic plate would be required to stop said projectile.

Figure 3:
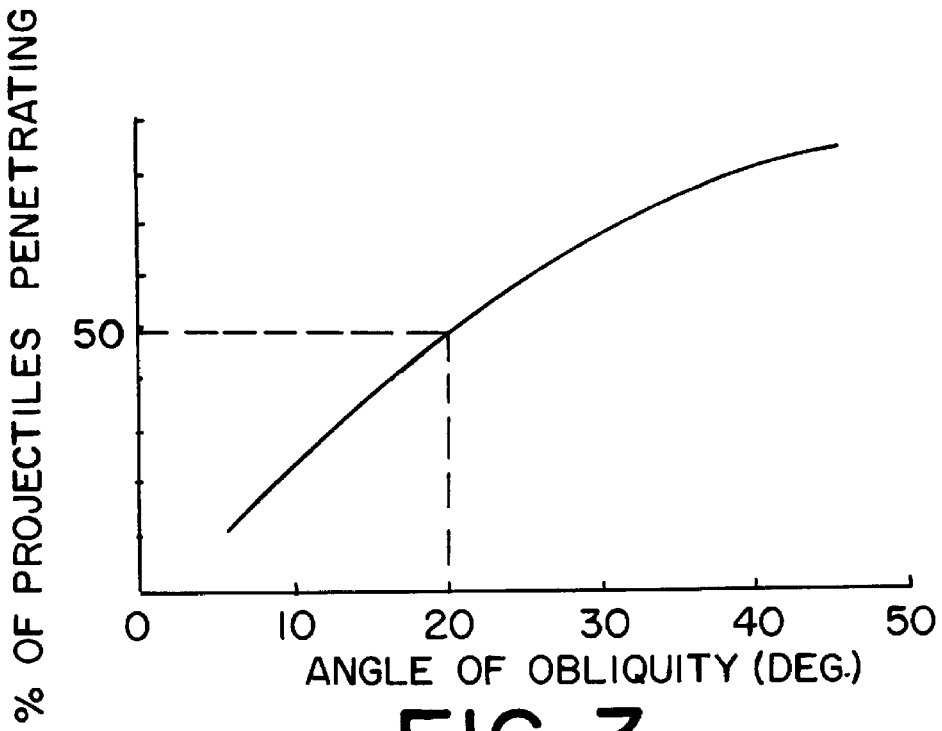
FIG. 3 is a graph showing the effect of obliquity of incoming projectiles on the stopping power of body armor.

FIG. 3 is a plot which shows the percentage of projectiles defeated by armor as a function of the their obliquity with respect to the surface of the armor. Angle of obliquity is the angle of the travel direction of said projectile to the surface plane of the armor.

Figure 4:
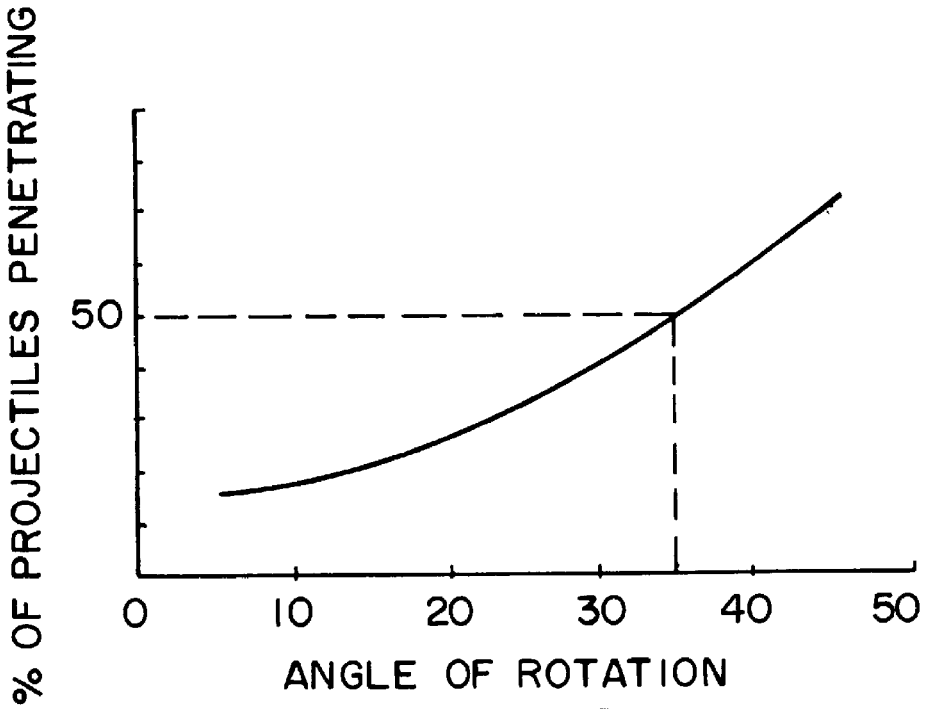
FIG. 4 is another graph illustrating the effect on an incoming projectile rotated with respect to its direction of travel on the stopping power of body armor.

FIG. 4 is another plot that depicts the percentage of projectiles defeated by armor as a function of the angle of rotation. Angle of rotation is the angle of the major axis of said projectile, such as a bullet, to the direction of its travel.

The difference between in the terms "obliquity" and "rotation" in the present context is as follows: a projectile oblique to the surface of the armor travels toward said armor in the direction coinciding with the major axis of said projectile; a projectile rotated with respect to the surface of the armor travels in the direction perpendicular to the surface of said armor.

Figure 5A:
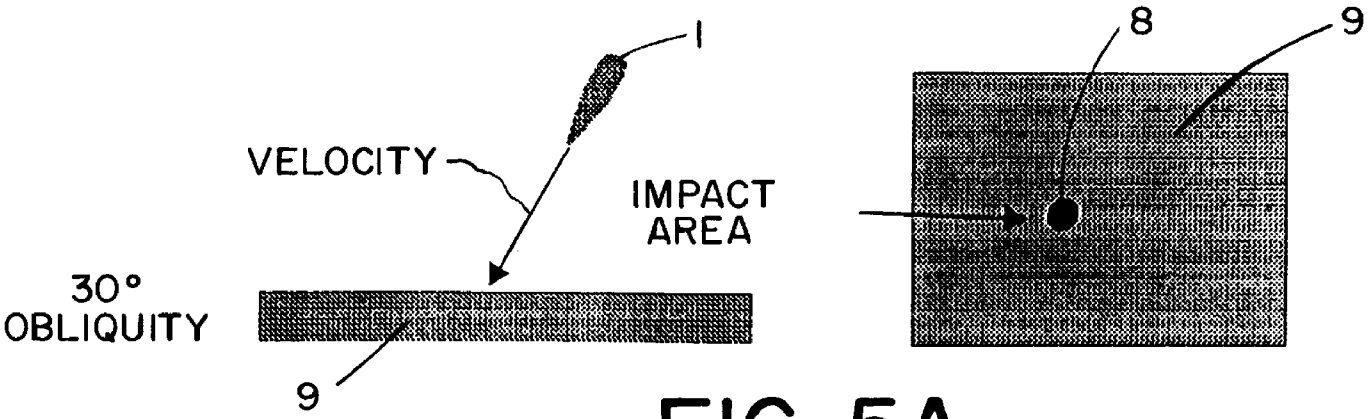
FIGS. 5A and 5B illustrate, respectively, the effects of obliquity and rotation of an incoming projectile on the size of the impact area FIGS. 6A and 6B schematically depict the difference between the impact mechanisms of a non-rotated and rotated projectile on a protective layer in a body armor.
Figure 5B:
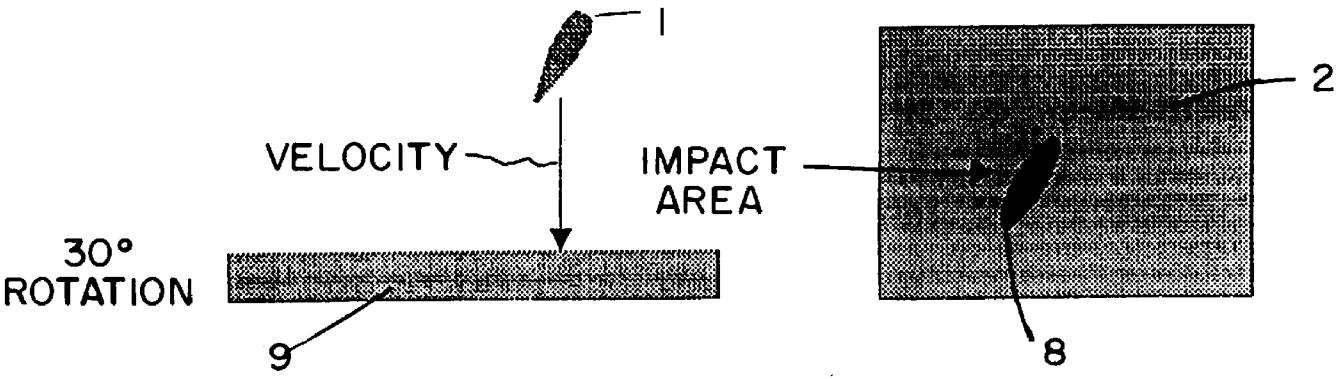

FIG. 5A and 5B illustrate the different results of impacts of, respectively, an oblique and a rotated projectile. The larger impact area in the second case is obvious, as is therefore the advantage of rotation vs. obliqueness in terms of defeating a projectile.

Figures 6A, 6B:
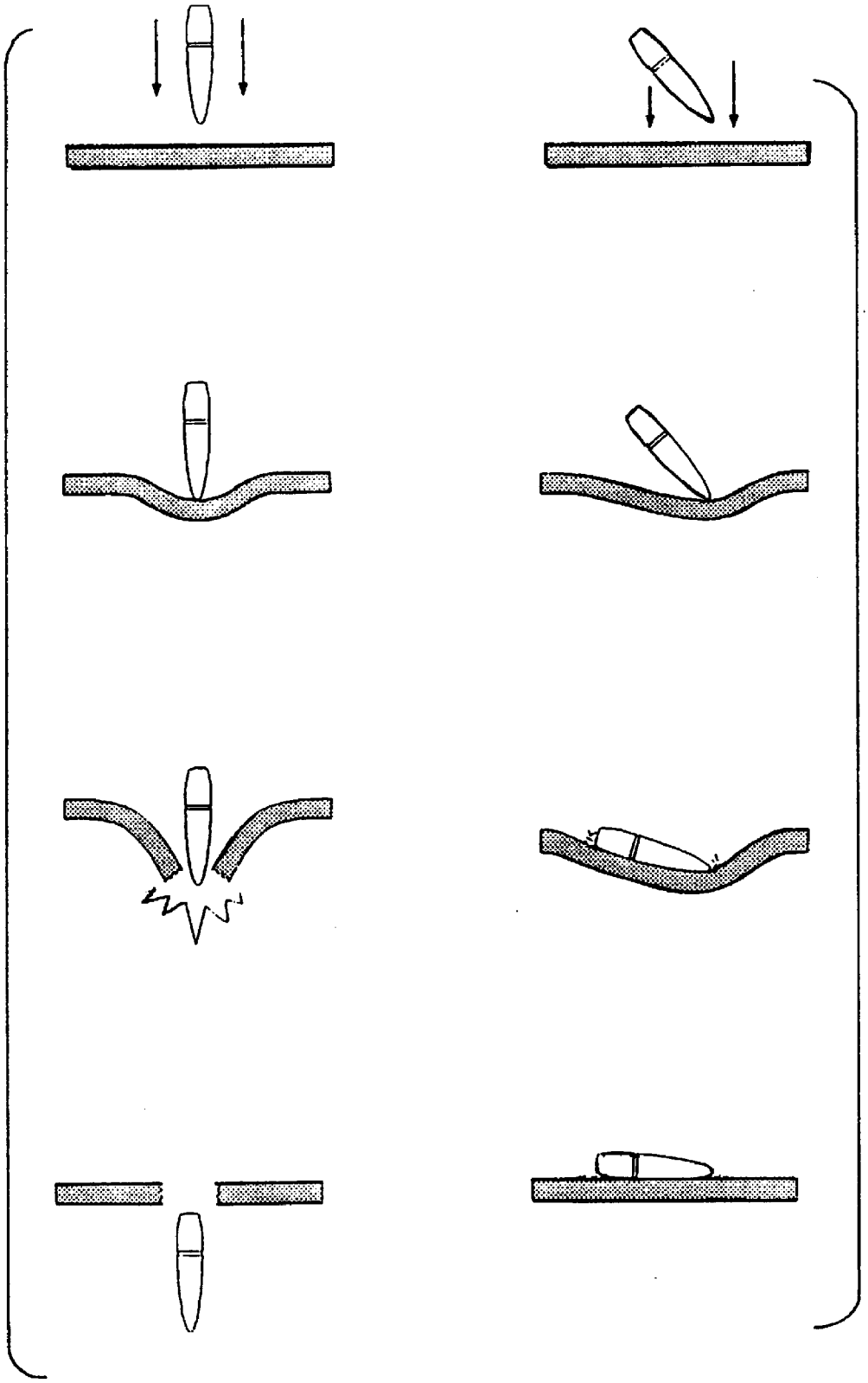

FIGS. 6A–6D show diagrammatically the advantage in terms of impact area of rotating the projectile from its initial orientation parallel with the direction of travel. In the case of ballistic material, such as Kevlar® polymer, the vertical impact with its smaller area and the consequent greater concentration of the projectile's kinetic energy will in many cases lead to penetration of the armor by said projectile (FIG. 6A). When said projectile, however, is rotated, penetration is more likely to be prevented (FIG. 6B).

The flexible, light-weight armor, object of this invention is shown in cross-section in FIG. 7. The Figure also illustrates the projectile defeat mechanism employed said armor when the projectile 1 impacts said armor normal to its surface.

This version of said armor consists of seven layers:

Layer 10, topmost, is ballistic fabric 10 the purpose of which is to slow down said projectile, to contain fragments of the rigid pyramids 18 generated during the impact of said projectile within the proper of the armor, and prevent the tips of the underlying pyramids to scratch or otherwise injure the wearer or others.

Figure 7A:
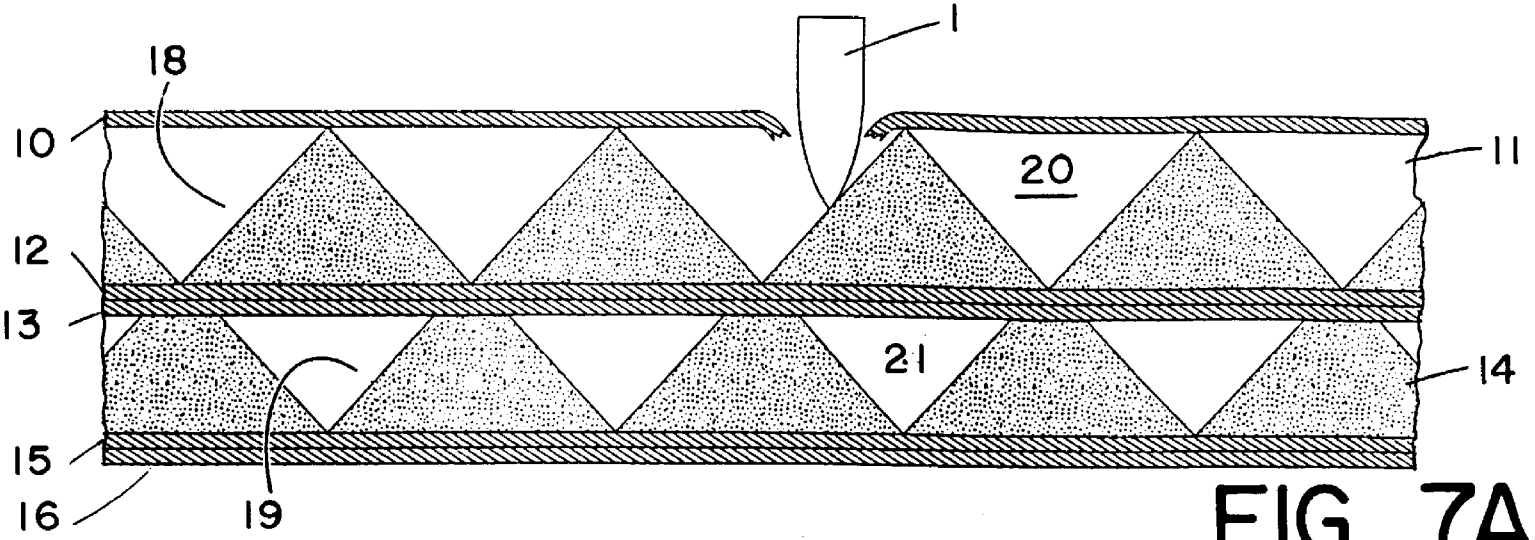
FIGS. 7A–7D show rotation of the projectile after the impact into one of the individual hard non-planar means object of this invention.
Figure 7B:
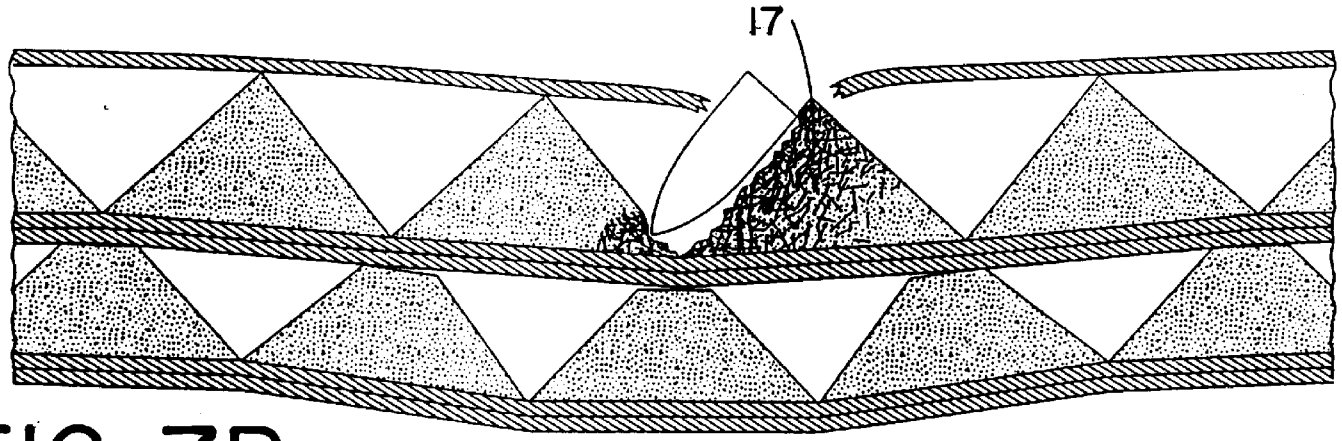
Figure 7C:
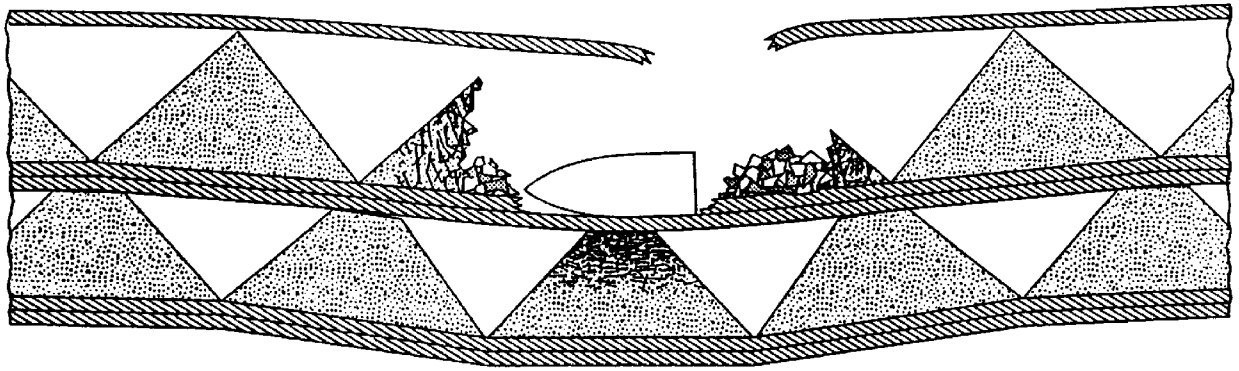
Figure 7D:
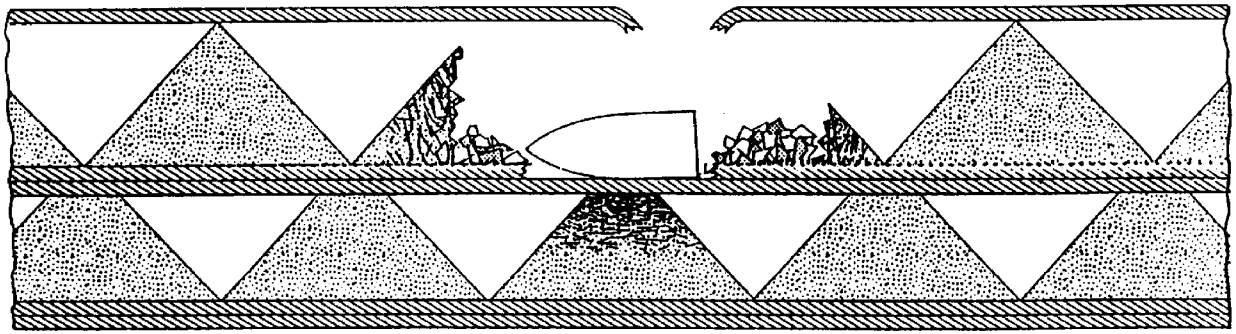
Figure 8A:
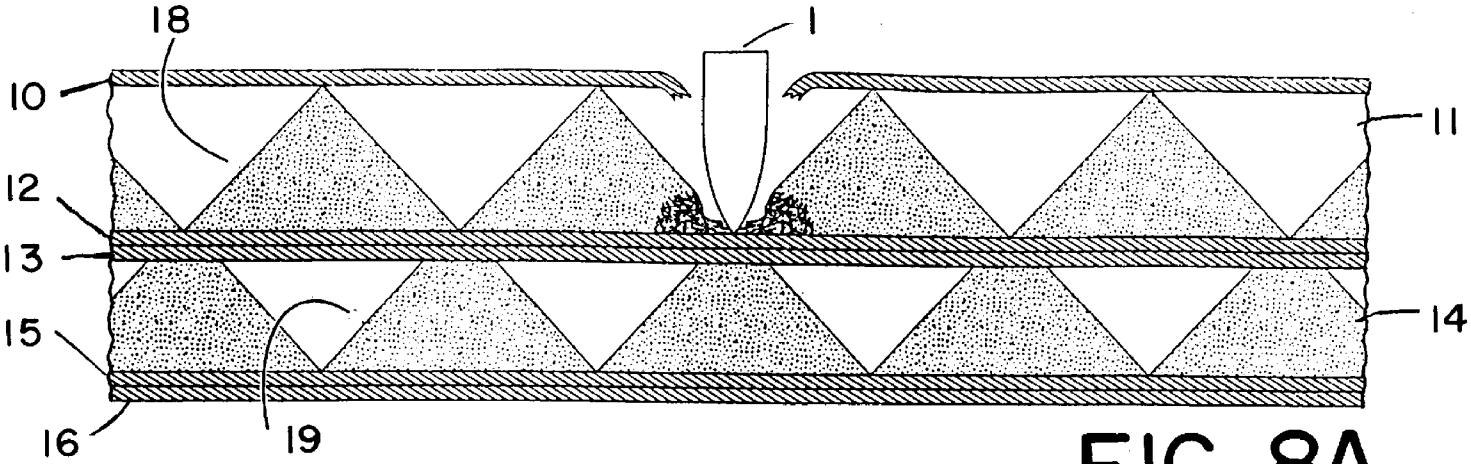
FIG. 8A–8D illustrate the rotation of a projectile which has penetrated the first protective layer at the juncture of said individual hard non-planar means.
Figure 8B:
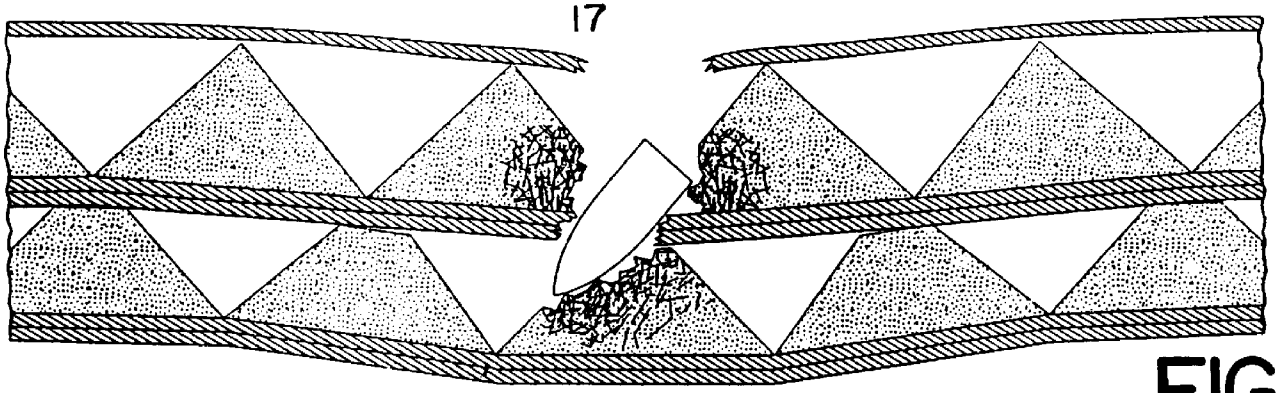
Figure 8C:
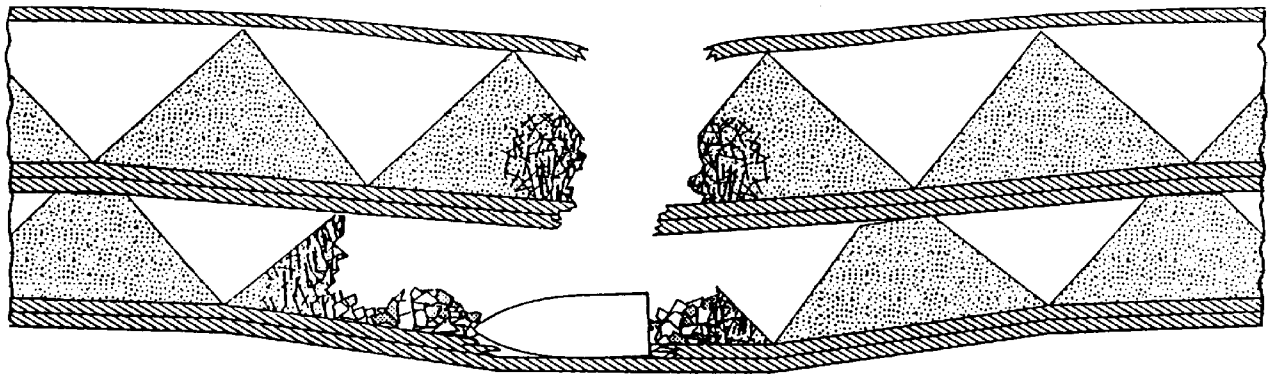
Figure 8D:
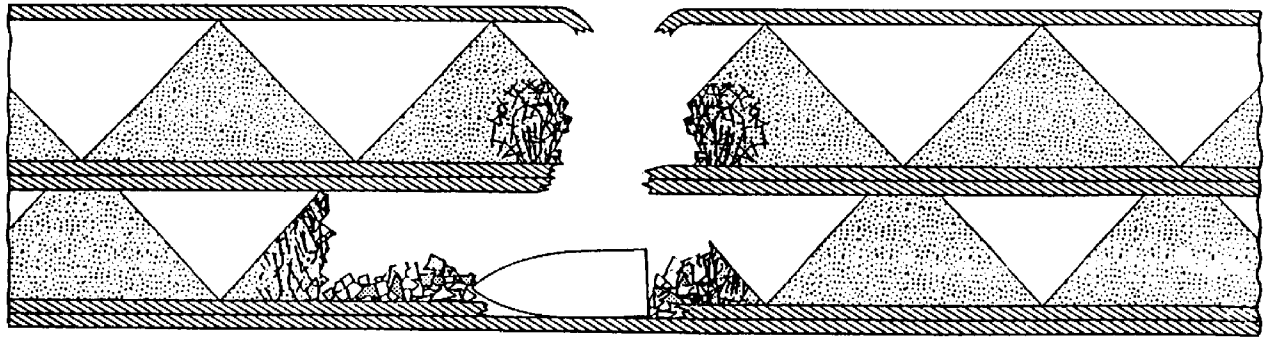
Figure 10:
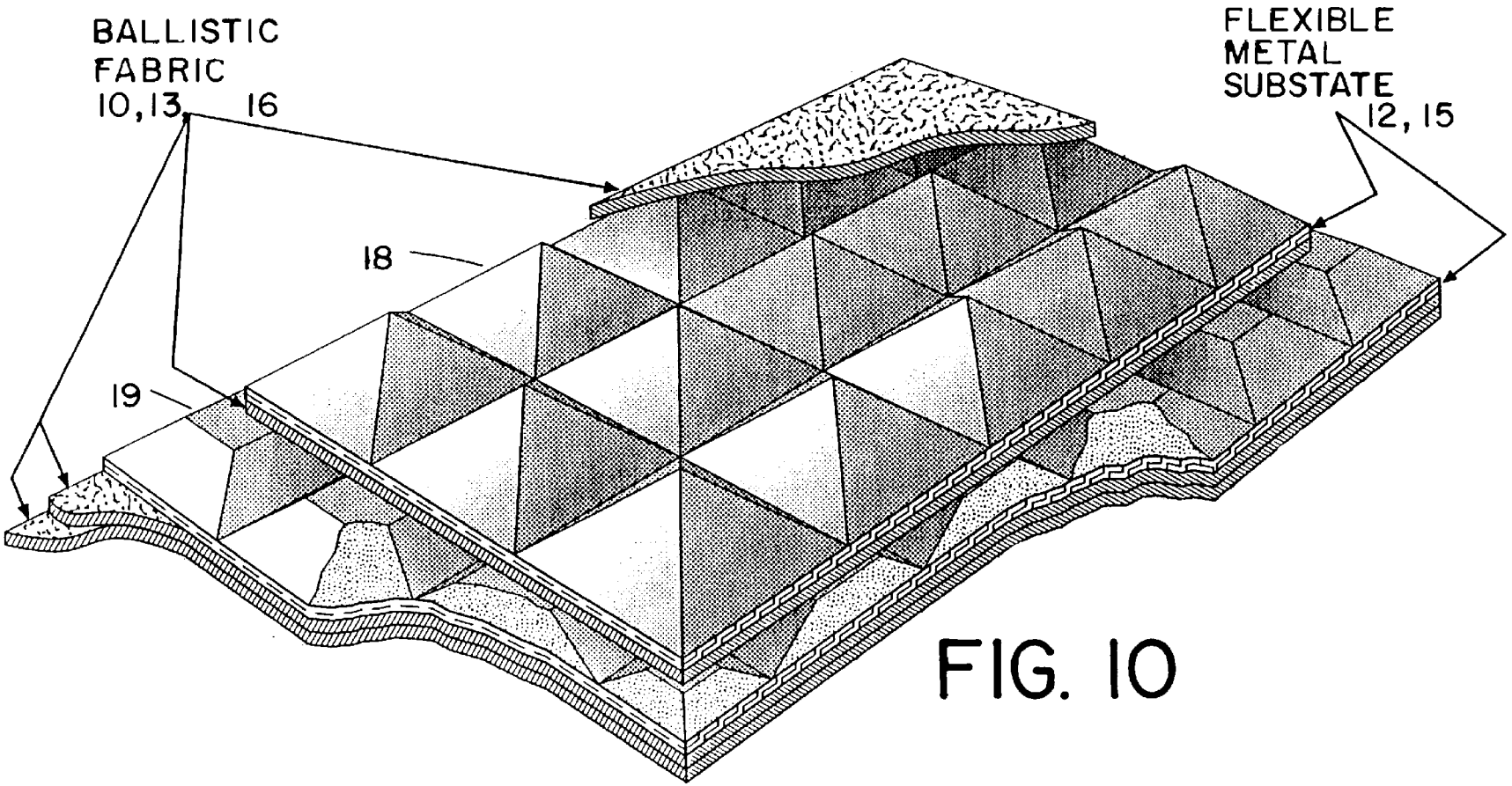
FIG. 10 is the three-dimensional depiction of a section of the flexible compound body armor in accordance with the present invention.

Layer 11 is a matrix of rigid, impact resistant pyramids 18 affixed to the layer 12, as shown in this Figure, woven or non-woven ballistic fabric, but can also be a metal mesh as indicated in FIG. 10. The purpose of said pyramids is to present an oblique angle to the impacting projectile 1 (FIG. 7A), thus causing said missile to rotate as depicted in FIG. 7B. Said pyramids can be made of ceramic, such as silicon carbide or boron nitride, metal, polymer, cermet or composite materials.

Layer 12, as mentioned above, can be woven or non-woven ballistic fiber, such as polyaramid or high density polyethylene, or a metal mesh. Layer 13 is made of ballistic woven or non-woven fabric. The purpose of layers 12 and 13 is to further absorb the already diminished impact energy of said projectile.

Layer 14 is a matrix of truncated pyramids the purpose of which is especially to prevent the penetration of any projectile that might enter the armor at the gaps or junctures between said pyramids 18 of said layer 11. This situation is depicted in FIG. 8.

Layers 15 and 16 are identical or similar to layers 12 and 13 and serve to provide a base for said truncated pyramids in the layer 14, and to provide an additional barrier to said projectile. Layer 15 can be either ballistic fabric or a metal mesh.

The spaces 20 and 21 between the pyramids 18 and pyramids 19, respectively, in layers 11 and 14 may be filled with soft polymeric foam that would absorb any fragments of the pyramids 18 and 19 and the projectile 1 that would be generated as a result of an impact.

Compared to rigid body armor or armor employing flat ceramic plates, the concept object of the present invention has several advantages:

It is more effective in defeating impacting projectiles because it employs the rotating mechanism.

It is far more flexible then the rigid armor.

It is expected that it will be easier to fabricate and to be less expensive than other types of body armor.

In contrast with rigid ceramic armor, it is capable of defeating multiple hits, since in each case the damage caused is localized.

A variety of different materials for the flexible layers and for the pyramids can be used, depending on the specific requirements.

The number of layers can be scaled up or down again depending on the application.

Figure 9:
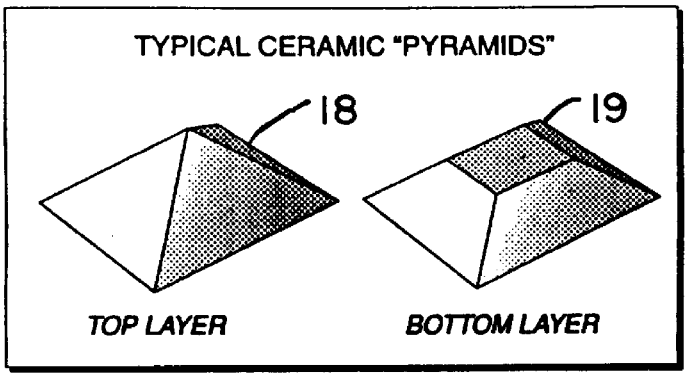
FIG. 9 shows the shapes of the two types of pyramid-like hard non-planar means.

FIG. 9 illustrates the shows possible the shapes of the two types of pyramids.

FIG. 10 shows the three-dimensional structure of object body armor, corresponding to the cross-sectional views of FIGS. 7 and 8. Note that in this version layers 12 and 15 consist of flexible metal mesh, and layers 10, 13 and 16 are made of woven or non-woven ballistic fabric.

Figure 11A:
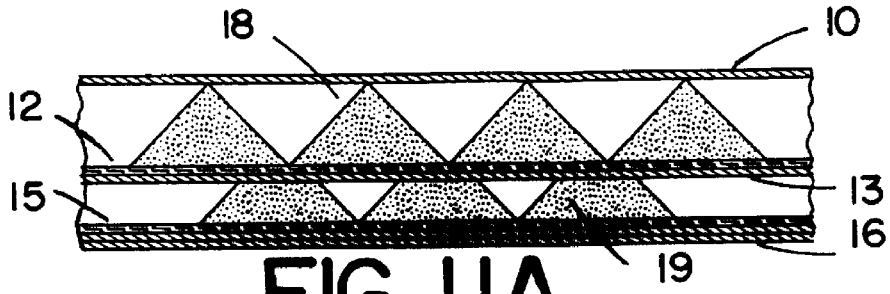
FIGS. 11A and 11B show how said body armor material flexes.
Figure 11B:
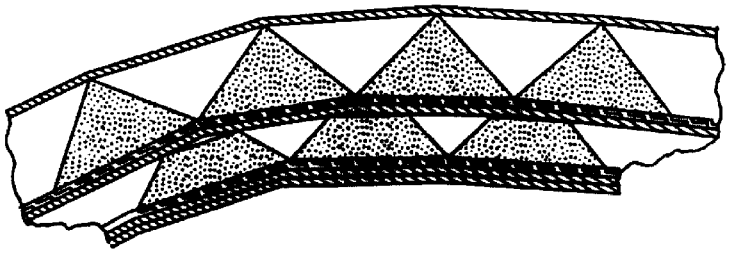

FIGS. 11A and 11B show the shapes of the pyramid-like hard non-planar structures in, respectively, top (11, FIG. 8A) and bottom (14, FIG. 8A) layers of said body armor.

It is to be understood that the preceding descriptions are illustrative only and that changes can be made in the body armor, object of this invention, its components, materials and elements, the sequences of operations and process steps, as well as in all other aspects of this invention discussed herein without departing form the scope of the invention as defined in the claims.

We claim:

1. Body armor for protection of individuals against impacting projectiles, said body armor comprising:

(a) a first protective layer of flexible material to the front surface of which are affixed in a first matrix configuration the bases of individual hard generally pyramidal elements for turning the direction of the impacting projectiles; (b) second protective layer formed of flexible material, to the front surface of which are affixed in a second matrix configuration the bases of individual hard generally truncated pyramidal elements for turning the direction of the impacting projectiles which may have penetrated said first matrix configuration, said generally truncated pyramidal elements in said second matrix are disposed such that their apexes are situated beneath the juncture points on said flexible material of the first said matrix configuration where the edges of at least three of said bases of said generally pyramidal elements of said first matrix configuration meet; and (c) at least one protective layer consisting of penetration-resistant fabric.

2. Body armor per claim 1 wherein said layers are flexible such that said armor is flexible.

3. Body armor per claim 1 in which said bases of said individual hard generally pyramidal elements are triangles.

4. Body armor per claim 1 in which said bases of said individual hard generally pyramidal elements are rectangles.

5. Body armor per claim 1 in which said bases of said individual hard generally pyramidal elements are trapezoids.

6. Body armor per claim 1 in which said bases of said individual hard generally pyramidal elements are polygons.

7. Body armor per claim 1 in which said bases of said individual hard generally pyramidal elements are squares.

8. Body armor per claim 1 in which said penetration-resistant fabric comprises fibers made of polymers selected from the group consisting of polyaramids and high density polyethylene.

9. Body armor per claim 1 in which said fabric is woven.

10. Body armor per claim 1 in which said fabric is non-woven.

11. Body armor per claim 1 in which said flexible material is a metal mesh.

12. Body armor per claim 1 in which said individual hard generally pyramidal elements of said first and second protective layers are made of metal.

13. Body armor per claim 1 in which said individual hard generally pyramidal elements of said first and second protective layer are made of ceramic.

14. Body armor per claim 1 in which said individual hard generally pyramidal elements of said first and second protective layer are made of cermet.

15. Body armor per claim 1 in which said individual hard generally pyramidal elements of said first and second protective layer are made of polymers.

16. Body armor per claim 1 in which said individual hard generally pyramidal elements of said first and second protective layer are made of composite materials.

17. Body armor per claim 1 in which the spaces between said individual hard generally pyramidal elements of said first and second protective layers are filled with soft polymeric material to provide protection against skin injury on the apexes of said individual hard generally pyramidal elements affixed to said first protective layer and to entrap any fragments of said projectile or said individual hard generally pyramidal elements, said fragments resulting from collision between said projectile and said individual hard generally pyramidal elements.

18. Body armor per claim 1 which is shaped to provide protection to the individual's torso, abdomen, neck and extremities.

19. Body armor for protection of individuals against impacting projectiles, said body armor comprising:

a first protective layer formed of flexible material, to the front surface of which is affixed a first matrix of individual hard generally pyramidal elements for turning the direction of the impacting projectiles;

a second protective layer formed of flexible material, to the front surface of which is affixed a second matrix of individual hard generally pyramidal elements for turning the direction of impacting projectiles;

one protective layer consisting of penetration-resistant fabric; said individual hard generally pyramidal elements in said first and second protective layers have their bases affixed to said flexible material and in which said bases are triangles.

20. Body armor for protection of individuals against impacting projectiles, said body armor comprising:

a first protective layer formed of flexible material, to the front surface of which is affixed a first matrix of individual hard generally pyramidal elements for turning the direction of the impacting projectiles;

a second protective layer formed of flexible material, to the front surface of which is affixed a second matrix of individual hard generally pyramidal elements for turning the direction of impacting projectiles;

one protective layer consisting of penetration-resistant fabric; said individual hard generally pyramidal elements in said first and second protective layers have their bases affixed to said flexible material and in which said bases are trapezoids.

21. Body armor for protection of individuals against impacting projectiles, said body armor comprising:

a first protective layer formed of flexible material, to the front surface of which is affixed a first matrix of individual hard elements shaped like pyramids for turning the direction of impacting projectiles;

a second protective layer formed of flexible material, to the front surface of which is affixed a second matrix of individual hard elements shaped like truncated pyramids for turning the direction of impacting projectiles;

one protective layer consisting of penetration-resistant fabric; said individual hard elements shaped like pyramids in said first protective layer and shaped like truncated pyramids in said second protective layer, have their bases affixed to said flexible material and in which said bases are triangles.

22. Body armor for protection of individuals against impacting projectiles, said body armor comprising:

a first protective layer formed of flexible material, to the front surface of which is affixed a first matrix of individual hard elements shaped like pyramids for turning the direction of the impacting projectiles;

a second protective layer formed of flexible material, to the front surface of which is affixed a second matrix of individual hard elements shaped like truncated pyramids for turning the direction of impacting projectiles;

one protective layer consisting of penetration-resistant fabric; said individual hard elements shaped like pyramids in said first protective layer and shaped like truncated pyramids in said second protective layer, have their bases affixed to said flexible material and in which said bases are trapezoids.

* * * * *